United States Patent [19]

Fernandez

[11] 4,051,782

[45] Oct. 4, 1977

[54] DOSING DEVICE ON AN INK FOUNTAIN

[75] Inventor: Eloy Fernandez, Heusenstamm, Germany

[73] Assignee: Roland Offsetmaschinenfabrik Faber & Schleicher AG, Germany

[21] Appl. No.: 740,106

[22] Filed: Nov. 9, 1976

[30] Foreign Application Priority Data

Nov. 12, 1975 Germany ..... 2550720

[51] Int. Cl.[2] ..... B41F 31/04

[52] U.S. Cl. ..... 101/365

[58] Field of Search ..... 101/365, 350, 157, 169, 101/207, 208

[56] References Cited

U.S. PATENT DOCUMENTS

| | | | |
|---|---|---|---|
| 2,902,927 | 9/1959 | Ross | 101/365 |
| 3,820,459 | 6/1974 | Paul | 101/365 |
| 3,898,931 | 8/1975 | Posselt | 101/365 |

FOREIGN PATENT DOCUMENTS

| | | | |
|---|---|---|---|
| 1,102,181 | 3/1961 | Germany | 101/365 |

*Primary Examiner*—J. Reed Fisher

*Attorney, Agent, or Firm*—Leydig, Voit, Osann, Mayer & Holt, Ltd.

[57] ABSTRACT

A mechanism for zonal adjustment of the blade of an ink fountain with respect to the fountain roller which is made up of adjustable subassemblies, each of which includes an adjusting pin secured to a slide. Adjacent each slide is a support member carrying a cylindrical adjusting member having an eccentric crank for engaging and positioning the slide. The adjusting member has a radially extending adjusting arm and a positive detent, the arm having a calibrated scale including a reference mark which is phased with the detent. Each pin is threaded into its slide so that when the adjusting arms are in detented reference position, the blade may be preliminarily adjusted, zone by zone, into accurate reference spacing with respect to the blade by turning the pins in one direction or the other in each of the subassemblies. The blade is finally adjusted in each zone by movement of the corresponding arm with respect to the calibrated scale to establish a running condition.

5 Claims, 5 Drawing Figures

10
11
FG
12
13
15
16
17
18
20
21
22
30
31
32
40
45
50
51
53
55
56
67
75
P
2
4
0.3
0.2
0.1
0
-0.1
REF. POS.
SHUT-OFF 1
15
19
20
31
32
40
45
47
50
51
53
54
55
56
60
67
P
0.3
0.2
0.1
0

40
41
42
50
60
71
72
73
74
75

15
16
17
18
19
20
23
24
30
31
40
41
42
45
50
60
70
75

REF. POS.
15
20
21
22
23
24
40
42
45
46
47
50
60
61
63
70
72
74
P

DOSING DEVICE ON AN INK FOUNTAIN

For adjusting the thickness of ink film on a fountain roller so that the right amount of ink is fed to each column position on the printed product, it is necessary to adjust the fountain blade on a zonal basis. This is conventionally accomplished by adjusting screws, one in each zone, or by adjusting pins which may be shifted endwise by manually adjustable cams. While efforts have been made to calibrate the adjustment in each zone, calibration is difficult to maintain because of the wear of the blade and because of the high degree of precision in the adjustment which is required. Thus, ink feed adjustment, in the past, has required a high degree of operating skill and has been largely a matter of trial and error.

It is, accordingly, an object of the present invention to provide a blade adjusting mechanism in which the spacing of the blade in each zone or column position can be adjusted with a high order of accuracy, using a calibrated scale, with a minimum of skill or experience on the part of the operator and which includes convenient provision for resetting the adjustment in each zone to an accurate reference or starting position, from which the feeding of ink in the particular zone may be either increased or decreased on a calibrated basis.

It is, therefore, an object of the invention to provide a blade adjusting mechanism for an ink fountain which preserves a high degree of accuracy in the calibration, independent of blade wear or other factors. Stated in other words, it is an object of the invention to provide an adjusting mechanism in which the reference setting and the amount of ink which is fed in each zone are both accurate and reproduceable over the life of the press, even though the mechanism may be disassembled from time to time for cleaning purposes and even though a new blade may be substituted.

It is a related object to provide an adjusting mechanism for an ink fountain which is highly economical to construct, install and maintain and which is inherently strong and durable to provide reliable operation over the life of the press.

Other objects and advantages of the invention will become apparent upon reading the attached detailed description and upon reference to the drawing in which.

Figure 1:
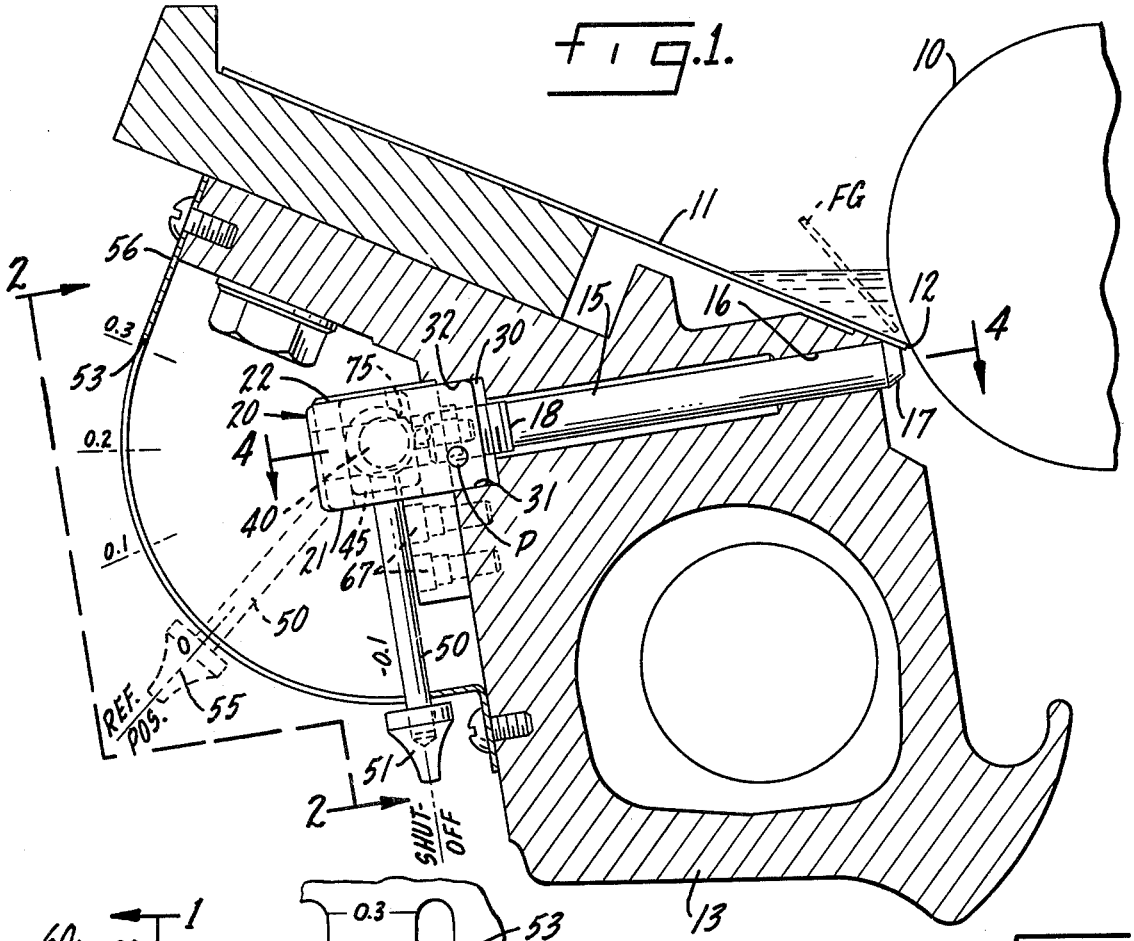
FIG. 1 is a vertical sectional view taken through the frame of an ink fountain constructed in accordance with the present invention, the section being taken on the line 1—1 of FIG. 2.
Figure 2:
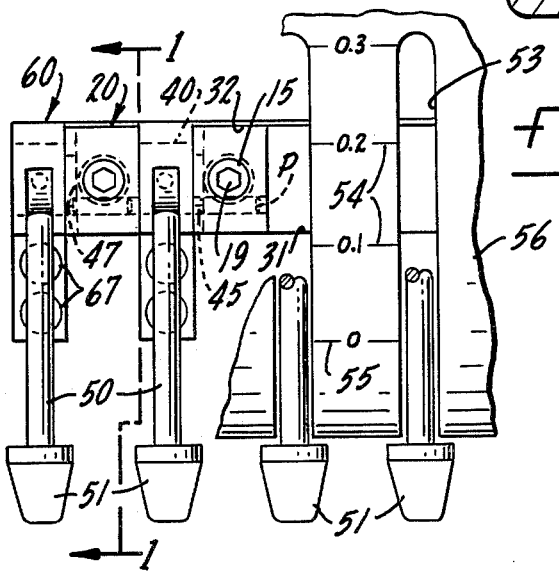
FIG. 2 is a fragmentary elevational view looking along the line 2—2 in FIG. 1.

While the invention has been described in connection with a preferred embodiment, it will be understood that I do not intend to be limited to the embodiment shown, but on the contrary intend to cover the various alternative and equivalent forms of the invention as included within the spirit and scope of the appended claims.

Turning now to the drawing, there is shown, in cross section, an ink fountain having an ink roller 10 cooperating with a fountain blade 11 having an edge portion

12. The fountain blade is mounted upon a frame 13 which extends longitudinally of the roller and which serves to contain a body of ink.

For the purpose of adjusting the spacing between the edge of the blade and the surface of roller to feed the appropriate amount of ink required in each column position, adjusting pins 15 are provided which are received, for endwise sliding movement, in bores 16 in the frame.

In accordance with the present invention, the adjusting mechanism is made up of subassemblies including cylindrical adjusting members which are rotatable in respective supporting members and which have eccentric crank connections with slides secured to the rear end portions of the respective pins, each cylindrical adjusting member having an adjusting arm with a calibrated scale and reference mark as well as a positive detent which is phased with the reference mark, the detents and reference marks all being alined. Each pin is threaded to its slide so that when the adjusting arms are in detented reference position, the blade may be preliminarily adjusted, zone by zone, into a reference spacing with respect to the blade.

Taking the pin 15 as representative, it has a tip 17 and a rear portion 18 with a tool-engaging recess 19 and which is in threaded engagement with a slide 20. The slide is in the form of a rectangular block of metal having lower and upper surfaces 21, 22 and lateral surfaces 23, 24, respectively parallel to one another. For the purpose of guiding each slide 20, it is received in a groove 30 which extends longitudinally of the frame, parallel to the roller, and which has parallel lower and upper surfaces 31, 32 which engage the surfaces 21, 22 of the slide.

For positioning the slide member 20, and adjusting member 40 is provided having a cylindrical surface 41 and having an eccentric crank 42 projecting axially therefrom. Interposed between the crank 42 and the slide is an intermediate follower member 45 consisting of a flat, rectangular wafer of metal having a central opening 46 dimensioned to receive the crank, the follower being snugly received in a vertical groove 47 formed in the slide, with the result that rocking movement of the cylindrical adjusting member in opposite directions is converted to endwise movement of the pin.

For the purpose of rocking, or angularly positioning, the adjusting member 40, it is provided with an arm 50 having a knob 51 at its outer end, the arm 50 projecting through a slot 53 formed in a shield 56 which is bent into arcuate shape. Cooperating with the arm and arranged adjacent the slot 53 is a calibrated scale 54 having a zero or reference mark 55.

To support and journal the cylindrical adjusting member, a support 60 is provided having a base portion 61 and which is mounted by means of a pair of screws 67, in vertical position bridging the slot 30. The supporting member 60 has a central clearance slot 63 which also serves to hold the arm 50, and hence the cylindrical member 40, captive against endwise movement.

It may be noted that each one of the slide members 20 is snugly supported in two directions: Not only are the lower and upper surfaces supported by the parallel walls of the groove 30, but the side surfaces 23, 24 are supportively engaged by the adjacent walls of support members 60. The support members and the slides thus, taken together, form a "sandwiched" assembly which extends the length of the fountain.

Figure 3:
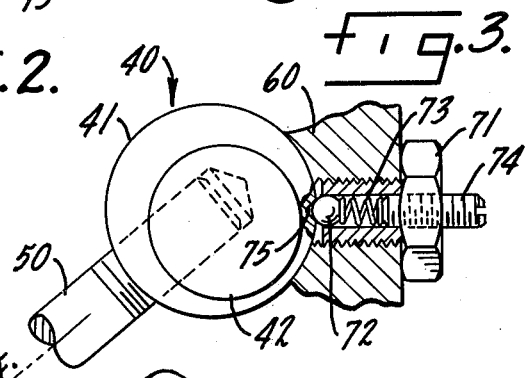
FIG. 3 is an enlarged profile view of the cylindrical adjusting member with its associated detent and showing the same in detented position.
Figure 4:
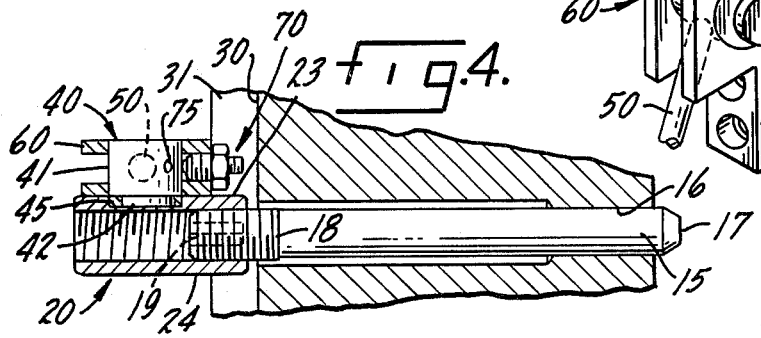
FIG. 4 is a fragmentary horizontal section taken through one of the adjusting subassemblies as viewed along line 4—4 of FIG. 1.
Figure 5:
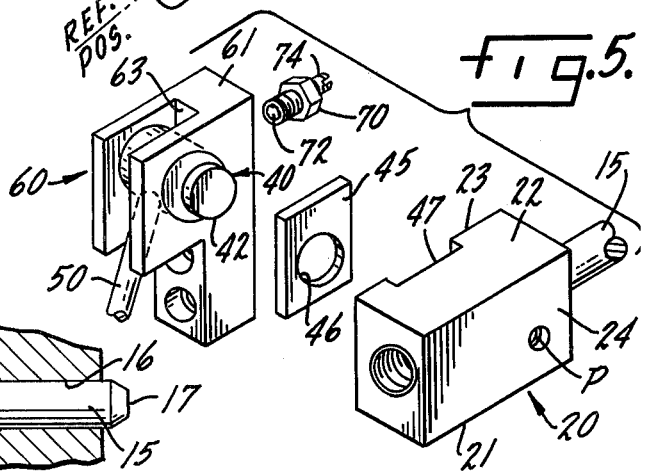
FIG. 5 is a partially exploded perspective.

In carrying out the present invention a detent is provided for the cylindrical adjusting member in each assembly, phased to provide detenting action when the adjusting arm occupies its reference position 55. A typical detent assembly 70, which is shown in slightly enlarged scale in FIG. 3, includes a threaded bushing 71 which is screwed into the base portion of the support member 60 and which has a central bore for containing a detent projection in the form of a ball 72. The ball is pressed by a cooperating spring 73 which is adjustable by a set screw 74. The ball cooperates with a dimpled recess 75 formed in the outer surface 41 of the adjusting member 40. As stated, it is a feature of the invention that the recess is so angularly positioned on the adjusting member 40 that the ball occupies the recess when the adjusting arm 50 is at reference position 55.

In a typical adjusting operation, all of the adjusting arms 50 are moved to their aligned reference positions 55. An Allen wrench or similar adjusting tool is then inserted into the socket 19 provided at the rear end of each pin and turned in one direction or the other until a feeler gauge, indicated at FG in FIG. 1, can just be inserted between the edge of the blade and the roller 10. Each pin may be held in its pre-adjusted position by means of a frictional "braking" pin P of nylon or the like. By adjusting the pin in each column position, a reference clearance condition is established all along the edge of the blade. The spacing between the edge of blade and the fountain roller in each column position may then be subsequently and finally adjusted by swinging the corresponding arm 50 upwardly with respect to the calibrated scale 54, to increase the amount of ink feed, or, conversely, by swinging the arm downwardly from the reference position to decrease the film thickness to less than the reference value.

The calibration of each scale 54 remains accurate for the life of the fountain. In the event that the blade should wear as the result of continued usage, or in the event that the mechanism must be disassembled for purposes of cleaning, or a new blade substituted, the original calibration can be precisely restored by repeating the setting procedure mentioned above, viz., by placing all of the adjusting arms 50 in reference detented position and by turning each of the pins by an adjusting tool until a feeler gauge can be snugly accomodated at the blade edge.

With the reference condition restored, all calibrated positions of the adjusting arms become immediately and accurately reproduceable. Consequently, the amount of ink fed at each column position is precisely determined without necessity for trial and error and adjustment of the fountain is possible by an operator having only limited skill and experience.

It is apparent that the objects of the invention have been fully carried out: An accurately calibrated adjusting mechanism has been provided with means for conveniently and periodically establishing a reference condition so that the calibration is maintained over the life of the device. The mechanism is inherently strong and durable, inherently economical, and requires little maintenance except for occasional disassembly for removal of any dried ink which might affect the free rotative movement of the parts. Such cleaning is, however, required only at infrequent intervals, since the mechanism is so fully shielded and protected.

If desired, each pin may be equipped at its rear end with a knurled adjusting knob, which is therefore included within the scope of the term "adjusting tool". While the eccentric crank 42 is effective, in the present construction, to move its associated pin positively in both directions, the invention also contemplates a one-way crank connection, with each pin having a restoring spring for return movement.

I claim:

1. A mechanism for adjusting the blade of an ink fountain with respect to a fountain roller comprising, in combination, a frame, a plurality of zonal adjusting subassemblies spaced along the blade at equal intervals, each subassembly including a pin slidable in the frame at right angles to the edge of the blade, the pin having a tip and a rear end portion, the tip being positioned to engage the edge of the blade at an angle thereby to hold the blade closely spaced to the cylinder, a slide secured to the rear end portion of the pin and guided for sliding movement with respect to the frame, a rotatable adjusting member having an eccentric crank engaging the slide for positioning the same, the adjusting member further having an adjusting arm projecting radially therefrom, the arm having a calibrated scale including a reference mark fixed with respect to the frame, the adjusting member having a positive detent phased with the reference mark, the pin being threaded into the slide and the rear end of the pin being engageable by a turning tool so that when the adjusting arms are in detented reference position the blade may be preliminarily adjusted, zone by zone, into a reference spacing with respect to the roller by turning the pin in one direction or the other in each of the subassemblies, all of the reference marks and all of the scale graduations being in axial alignment with one another, the blade being finally and individually adjustable in each zone by movement of the corresponding arm with respect to its calibrated scale to establish a running condition.

2. The combination as claimed in claim 1 in which the reference marks occupy aligned positions in the central portion of the calibrated scales so that after the blade has been adjusted to reference spacing by turning of the pins, the spacing of the blade from the roller in each zone may be adjusted, for the running condition, to be either greater or less than the reference spacing.

3. A mechanism for adjusting the blade of an ink fountain with respect to a fountain roller comprising, in combination, a frame, a plurality of zonal adjusting subassemblies spaced along the blade at equal intervals, each subassembly including a pin slidable in the frame at right angles to the edge of the blade, the pin having a tip and a rear end portion, the tip being positioned to engage the edge of the blade at an angle thereby to hold the blade closely spaced to the cylinder, a slide secured to the rear end portion of the pin and guided for sliding movement with respect to the frame, a support member mounted on the frame adjacent the slide, said support member having a transverse cylindrical opening, a cylindrical adjusting member fitted in and rotatable in the opening, the cylindrical adjusting member having an eccentric crank for engaging and positioning the slide, the cylindrical adjusting member further having an adjusting arm projecting radially therefrom, the arm having a calibrated scale including a reference mark fixed with respect to the frame, the cylindrical adjusting member having a positive detent phased with the reference mark, the pin being threaded into the slide and the rear end of the pin being engageable by a turning tool so that when the adjusting arms are in detented reference position the blade may be preliminarily adjusted, zone by zone, into a reference spacing with respect to the roller by turning the pin in one direction or the other in each of the subassemblies, all of the reference marks and all of the scale graduations being in axial alignment with one another, the blade being finally and individually adjustable in each zone by movement of the corresponding arm with respect to its calibrated scale to establish a running condition.

4. The combination as claimed in claim 3 in which the frame has a parallel-sided groove arranged parallel to the fountain roller for guiding all of the slides for sliding movement, the support members being secured in bridging relation to the groove, each support member having a base portion overlying the groove and having a central slot for accomodating the vertical swinging movement of the arm.

5. The combination as claimed in claim 3, the detent being in the form of a spring-pressed projection mounted in the base portion of the support member and cooperating with a recess in the outer wall of the cylindrical adjusting member.

* * * * *